US007100288B2

(12) United States Patent
Köhler et al.

(10) Patent No.: US 7,100,288 B2
(45) Date of Patent: Sep. 5, 2006

(54) CUTLERY

(75) Inventors: Claudia Köhler, Berlin (DE); Volker Battke, Berlin (DE)

(73) Assignee: WMF Wuerttembergische Metallwarenfabrik AG, Geislingen (DE)

( * ) Notice: Subject to any disclaimer, the term of this patent is extended or adjusted under 35 U.S.C. 154(b) by 0 days.

(21) Appl. No.: 11/122,886

(22) Filed: May 5, 2005

(65) Prior Publication Data

US 2006/0174489 A1 Aug. 10, 2006

(30) Foreign Application Priority Data

Feb. 9, 2005 (DE) ..... 20 2005 002 065 U

(51) Int. Cl.
*B26B 11/00* (2006.01)
*A47J 43/28* (2006.01)

(52) U.S. Cl. ..... 30/329; 30/147; 30/322; 30/324; 7/118; 7/167; 7/900; 206/499; 206/509; 206/512; 206/553; 220/735; 224/232

(58) Field of Classification Search ..... 30/329, 30/334, 335, 336, 337, 147, 148, 149, 150; 7/118, 151, 156, 167, 168, 900; D7/637, D7/649, 664; 224/232; 73/426; D10/46.3; 206/499, 504, 509, 510, 512, 553, 372, 373; 220/735

See application file for complete search history.

(56) References Cited

U.S. PATENT DOCUMENTS

| | | | | |
|---|---|---|---|---|
| 250,281 | A * | 11/1881 | Praunegger | 30/143 |
| 3,030,812 | A * | 4/1962 | Lutz | 73/426 |
| 3,389,412 | A * | 6/1968 | Emmons | 7/152 |
| 3,400,591 | A * | 9/1968 | Larson | 73/426 |
| D318,600 | S * | 7/1991 | Lillelund et al. | D7/643 |
| 5,920,993 | A * | 7/1999 | Wenk | 30/324 |
| 6,619,487 | B1 * | 9/2003 | Stuchlik, III | 211/70.7 |
| 2005/0278958 | A1 * | 12/2005 | Schmidt | 30/324 |

FOREIGN PATENT DOCUMENTS

| | | |
|---|---|---|
| AT | 201258 | 12/1958 |
| DE | 1701021 | 6/1955 |
| DE | 1767520 | 5/1958 |
| DE | 2548804 | 5/1977 |
| DE | 8436034 | 3/1985 |
| DE | 29518294 | 5/1996 |
| DE | 20103746 | 2/2002 |

* cited by examiner

*Primary Examiner*—Boyer D. Ashley
*Assistant Examiner*—Edward Landrum
(74) *Attorney, Agent, or Firm*—Marshall, Gerstein & Borun LLP

(57) ABSTRACT

A set of cutlery includes a plurality of superimposable cutlery components, which are adapted to be releasably connected so as to form a transportable unit. In order to facilitate the handling of such cutlery, it is suggested that the cutlery components should be accommodated in a protective housing and that they should be releasably secured to the protective housing by a connection element.

12 Claims, 5 Drawing Sheets

CUTLERY

REFERENCE TO RELATED APPLICATION

This disclosure claims priority to German application no. 202005002065.6, filed Feb. 9, 2005.

FIELD OF THE INVENTION

The present disclosure relates to cutlery comprising a plurality of superimposable cutlery components, which are adapted to be releasably connected so as to form a transportable unit.

BACKGROUND OF THE DISCLOSURE

Cutlery of this type is known from DE 25 48 804 A. The known cutlery is implemented as picnic or camping cutlery and comprises a plurality of cutlery components having correspondingly cup-shaped handles with the aid of which they can be stacked one on top of the other. One of the cutlery components has additionally secured thereto a projecting pin, and the other cutlery components can be pushed over said pin with a respective slot-shaped opening. When the cutlery components are pushed on top of one another, the curved handles must be subjected to slightly resilient bending; this will guarantee that the cutlery components hold together in the superimposed condition, at least as long as they are not acted upon by a stronger force. For holding the handles together, a clip is additionally provided, which is adapted to be resiliently pushed over the handles from the side, said clip being preferably implemented as a tin opener. The cutlery additionally comprises a bottle opener, which is, however, implemented and stacked in the same way as the cutlery components so that it cannot be used in the closed position of the cutlery. Furthermore, the cutlery components are exposed during transport and are therefore liable to get dirty, or they must be wrapped in a cloth or accommodated in a soft, specially manufactured cutlery bag, a circumstance which will entail additional expense.

DE 1 701 021 U discloses another set of camping cutlery in the case of which the cutlery components are accommodated in a two-part, rigid receptacle. The receptacle components are, in turn, implemented as vessels, e.g. as a drinking cup or as a flower vase. The cutlery components are neither interconnected nor are they connected to the receptacle so that an unpleasant clattering noise will have to be expected when they are transported.

Furthermore, a large number of suggestions has been made for the structural design of cutlery components, which are adapted to be connected so as to form a transportable unit, cf. e.g. AT 201 258 C, DE 1 767 520 U, DE 84 36 034 U, or DE 295 18 294 U; all these suggestion have, however, the above-mentioned disadvantages.

SUMMARY OF THE DISCLOSURE

It is the object of the present disclosure to provide cutlery which is improved such that it can be handled more easily.

The structural design according to the present disclosure has the effect that, on the one hand, the cutlery components are effectively protected against dust and dirt, without any additional measures being necessary. On the other hand, the cutlery components are effectively fixed in the protective housing by the connection means so that they cannot get lost and so that they will be prevented from causing unpleasant noise.

A structural design which will be particularly useful as a connection means is an embodiment in the case of which the cutlery components are automatically locked with the protective housing, when said cutlery components are inserted in said protective housing, and automatically released, when they are removed from said housing. This function is realized in a particularly effective manner in the case of an arresting connection comprising at least one resiliently movable arresting element.

According to an alternative or, preferably, an additional embodiment, the cutlery components can be connected to the protective housing via an ear, which extends through a connection opening in the protective housing and which is releasably locked on the outer surface of said housing. This connection means can, in a simple manner, also be used as a fastening means for fastening a carrying strap or the like; connection of the carrying strap to the protective housing can, in this case, be carried out simultaneously with the locking of the ear in the protective housing.

If the plurality of cutlery components comprises a bottle opener, it will be possible to handle the cutlery according to the present disclosure much more easily, when said bottle opener is accommodated in a protective housing together with the cutlery components and when it is accessible through a opening in the protective housing so that it can fulfill its function. It will then not be necessary to remove all the cutlery components and the bottle opener from the protective housing for the sole purpose of opening a bottle. This embodiment is useful for cutlery components which are releasably connected to the protective housing via a connection means as well as for cutlery components in the case of which no such connection is provided.

The storage space required for keeping the cutlery according to the present invention will be reduced to the absolutely necessary minimum, when the cutlery components are accommodated in a protective housing of dimensionally stable material, which is adapted to the shape of the cutlery components in an etui- or case-like manner and which encompasses the cutlery components such that they are secured in position; this kind of protective housing may perhaps also replace the connection means between the cutlery components and the protective housing, although the provision of the connection means between the cutlery components and the protective housing is preferred so as to additionally secure the cutlery components in position in said housing.

The removal of the cutlery components will be facilitated still further when the cutlery components are also connected to one another, said connection being provided by an arresting connection that can be unlocked and re-locked in a particularly simple manner. Such an arresting connection is also suitable for interconnecting cutlery components which are not accommodated in an additional protective housing.

The storage space required for the cutlery will be reduced still further, when the bottle opener is not implemented as a separate cutlery component, but integrated in the other cutlery components by providing each cutlery component with a bottle opener aperture, said bottle opener apertures being in alignment in the superimposed condition of the cutlery components so that a bottle opener edge as well as the free space, which is necessary for application to a crown cork or the like, will be formed. Also, this embodiment can be realized in the case of cutlery which need not necessarily be accommodated in a protective housing.

A set of cutlery which can be connected in a particularly space-saving manner so as to form a transportable unit will be obtained, when the respective cutlery components are produced from an elongate, substantially rectangular strip of material, the respective function area being formed on the front end of each strip of material; this kind of cutlery need not necessarily be accommodated in a protective housing, nor is it necessary to interconnect the cutlery components with the aid of an arresting connection.

The cutlery according to the present invention is preferably implemented as pocket cutlery whose length is substantially reduced in comparison with that of normal flatware so that it can easily be accommodated in rucksacks, the pocket of a jacket or a vest, trouser pockets or the like.

BRIEF DESCRIPTION OF THE DRAWINGS

One embodiment of the present disclosure will be explained in detail hereinbelow making reference to the drawings, in which.

DETAILED DESCRIPTION OF THE DISCLOSURE

Figure 1:
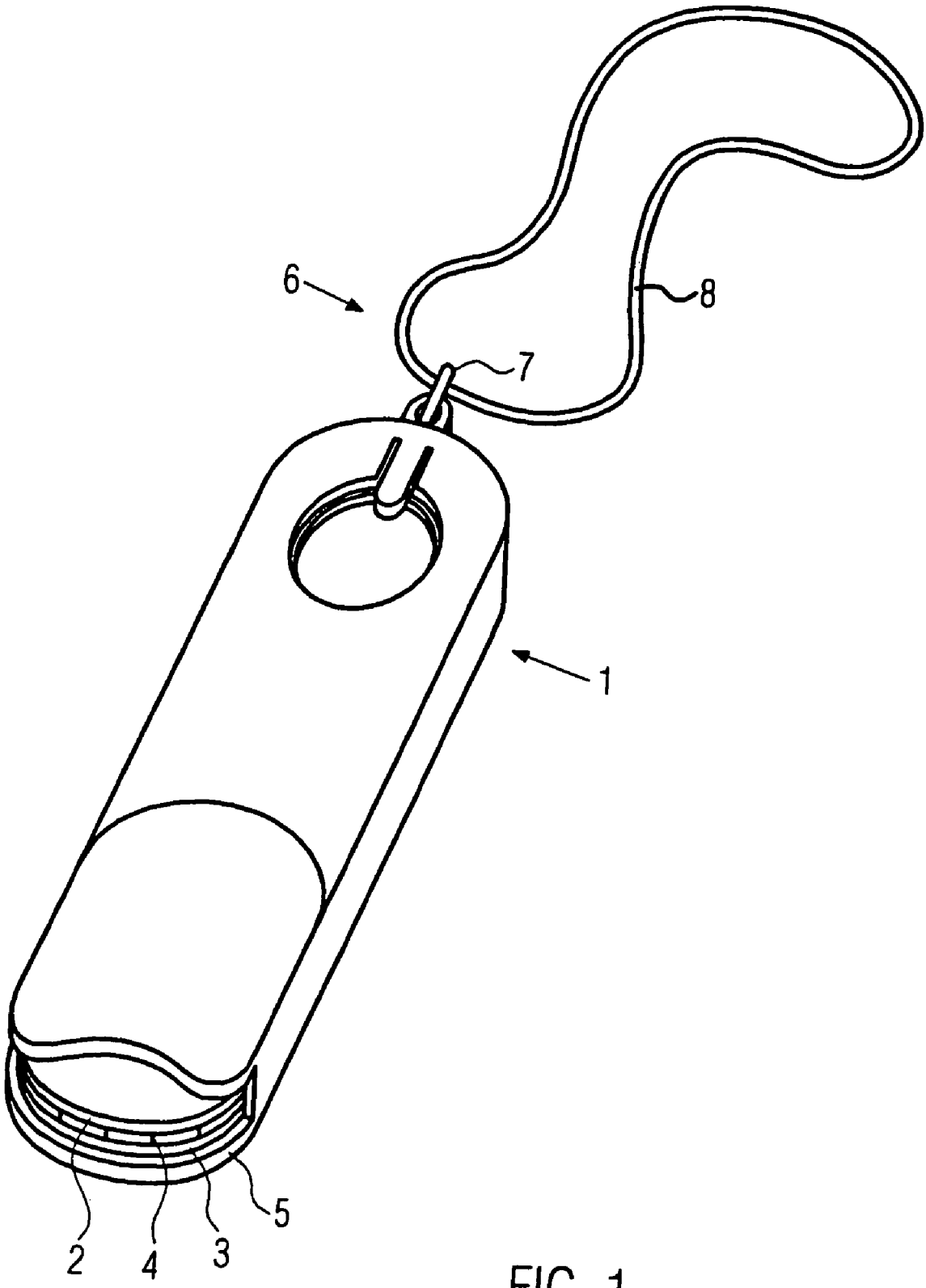
FIG. 1 shows a perspective representation of a cutlery according to the present disclosure.

FIG. 1 shows in a perspective, schematic representation, a set of cutlery 1 implemented according to the present disclosure, which is assembled such that it forms a transportable unit and which comprises a plurality of cutlery components 2, 3, 4, in particular a spoon 2, a knife 3 and an intermediate fork 4, which are accommodated in a housing 5 in a manner that will be described hereinbelow. The cutlery 1 according to the present disclosure is implemented as pocket cutlery and provided with a carrying means 6 with the aid of which the cutlery 1 can be undetachably fastened or simply be held on the wrist or in the hand. The carrying means 6 comprises a fastening means 7 for fastening a carrying strap 8 or a carrying string or the like, said carrying strap or string being preferably fastened in a detachable manner. The fastening means 7 may e.g. be one of the conventional karabiners.

Figure 2:
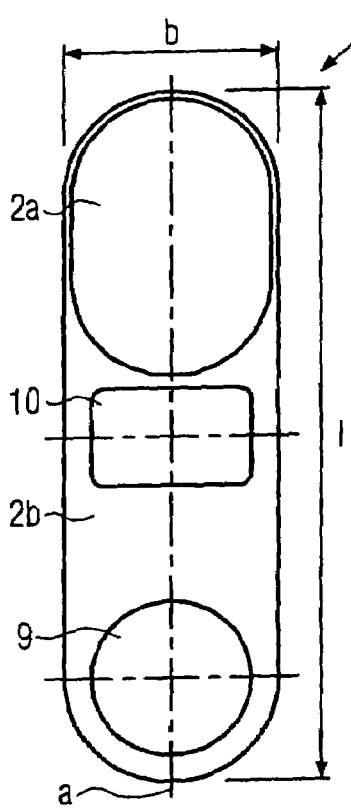
FIG. 2 shows a top view of a cutlery component, in the form of a spoon, according to the present disclosure.
Figure 3:
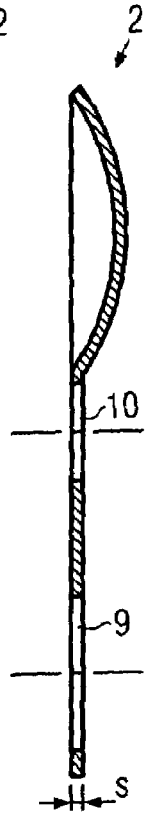
FIG. 3 shows longitudinal section of the spoon according to FIG. 2.

FIGS. 2 to 7 show the cutlery components of the cutlery 1 according to the present disclosure. FIGS. 2 and 3, for example, show the spoon 2. The spoon 2 comprises a function area 2*a*, i.e. a concave front part in the form of a rounded hollow which spoons normally have on one end thereof, and a handle area 2*b* extending towards the other end. The handle area 2*b* has provided therein a first throughhole 9. The opening 9 is preferably provided in the vicinity of the handle area end facing away from the concave front part 2*a* and is preferably circular in shape. The opening 9 is implemented as a locking opening for fastening the cutlery components 2, 3, 4 relative to one another, as will be explained in detail hereinbelow. Another opening 10 is provided between the opening 9 and the concave front part 2*a*, preferably at the largest possible distance from the rear end; this opening 10 is implemented as a bottle opener aperture, as will also be described in detail hereinbelow. The opening 10 may have any suitable shape, but it is preferably rectangular in shape with rounded edges, and it is arranged such that its longer sides extend transversely to the longitudinal centre line a. The concave front part 2*a*, the opening 10 and the opening 9 are each arranged symmetrically with respect to the longitudinal centre line a.

Figure 4:
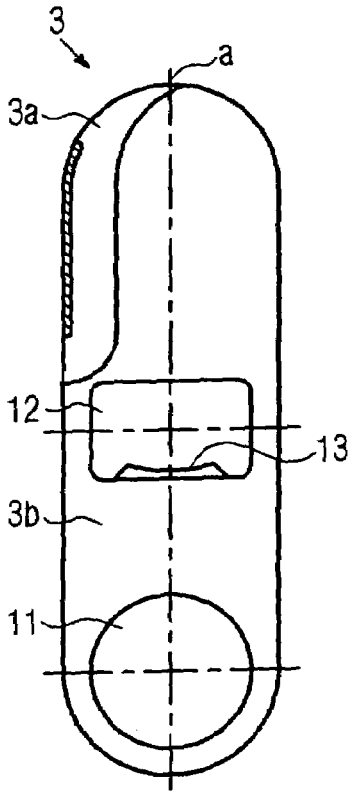
FIG. 4 shows a cutlery component, in the form of a knife, according to the present disclosure.
Figure 5:
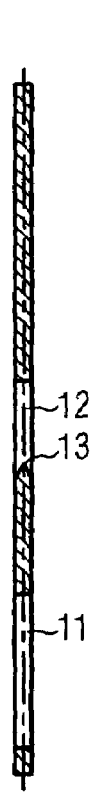
FIG. 5 shows a longitudinal section of the knife according to FIG. 4.

FIGS. 4 and 5 show an additional cutlery component in the form of the knife 3. Also the knife 3 comprises a function area 3*a* and a handle area 3*b*. The function area 3*a* is implemented as a cutting edge which, in the embodiment shown, additionally takes the form of a serrated knife. The cutting edge 3*a* is only provided on one side of the longitudinal centre line a, but it may also be provided on both sides thereof.

Also the handle area 3*b* has provided therein a throughhole 11 in the vicinity of the knife end facing away from the cutting edge 3*a*; also this opening 11 is circular in shape and arranged symmetrically with respect to the longitudinal centre line a, and its size corresponds to that of the opening 9. Also the opening 11 defines an aperture of an arresting connection with the aid of which the cutlery components 2, 3, 4 can be interconnected.

A further opening 12, which is implemented as a bottle opener aperture, is provided between the opening 11 and the cutting edge 3*a*. The opening 12 corresponds to the opening 10 in the spoon 2 with regard to its shape, size and mode of arrangement, but it is provided with a bottle opener edge 13 having the slightly rounded, edge-like shape which is normally provided in the case of bottle openers. The bottle opener edge 13 is arranged on the side of the bottle opener aperture which faces the opening 11 and it extends into the bottle opener aperture 12.

Figure 6:
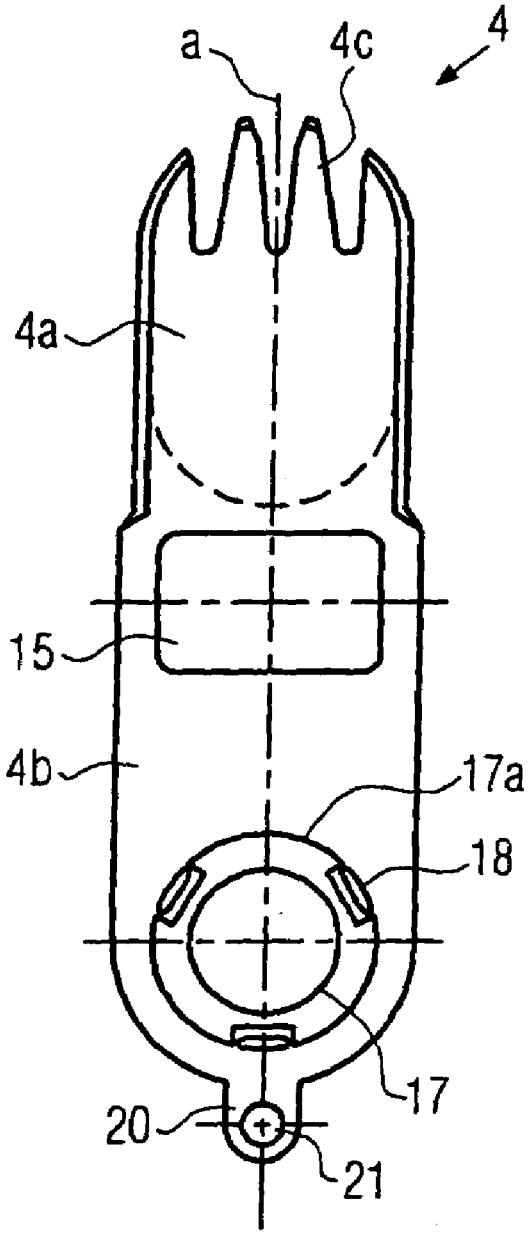
FIG. 6 shows a cutlery component, in the form of a fork, according to the present disclosure.
Figure 7:
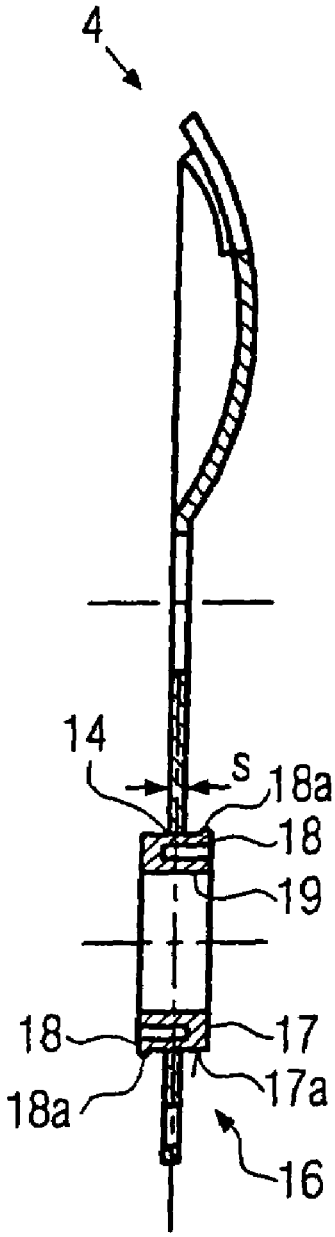
FIG. 7 shows a longitudinal section through the fork according to FIG. 6.
Figure 8:
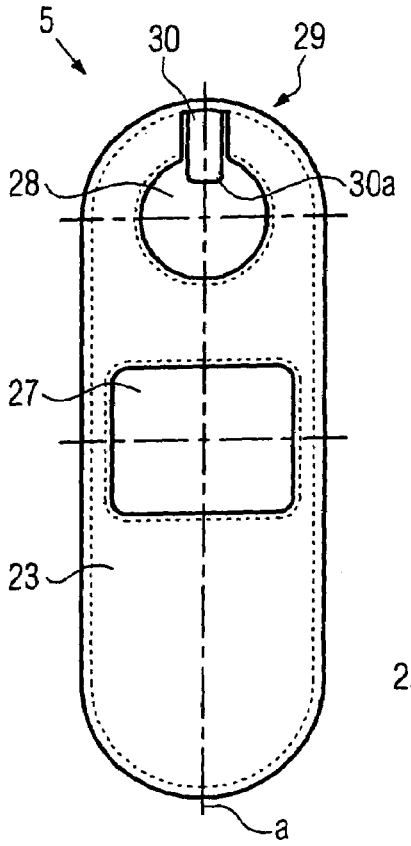
FIG. 8 shows a top view of one side of a protective housing of the cutlery according to the present disclosure.
Figure 9:
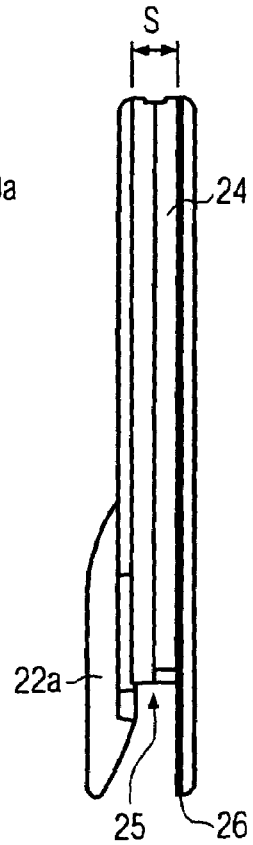
FIG. 9 shows the side view of the protective housing according to FIG. 8.
Figure 10:
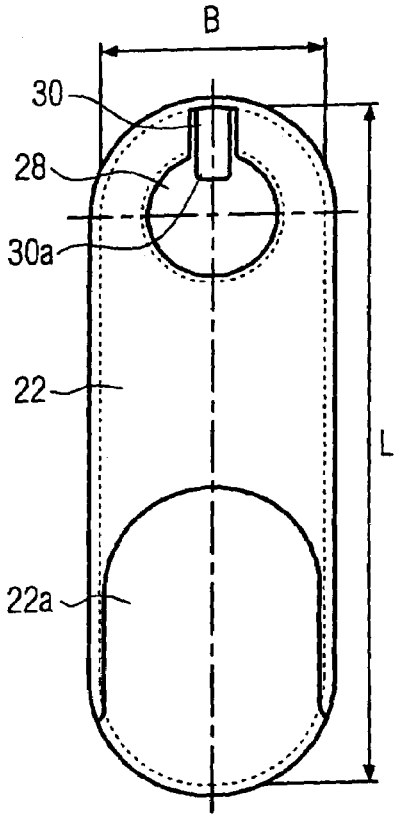
FIG. 10 shows a top view of another side of the protective housing.
Figure 11:
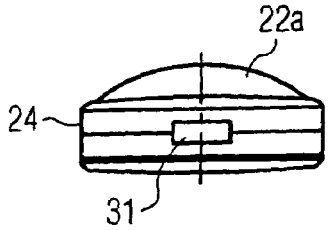
FIG. 11 shows a front view of the protective housing.

FIGS. 6 and 7 show the fork 4. The fork 4 comprises a function area 4*a* which is followed by a handle area 4*b*. The function area 4*a* is provided with a concave cavity of the type existing in the case of the spoon as well, and it additionally includes wedge-shaped slots so as to form tines 4*c*. In order to be able to use the same concave shape as in the case of the spoon 2 and in order to guarantee nevertheless a large-area contact of the spoon 2 and of the fork 4, the function area 4*a* is slightly smaller than that of the spoon 2 on both side of the longitudinal centre line a.

Also the fork 4 is provided with an opening 14 in the vicinity of the fork end facing away from the function area 4*a*; this opening 14 corresponds to the openings 9 and 11 in the spoon 2 and in the knife 3 with regard to its shape, size and mode of arrangement. Furthermore, an opening 15 is provided, which is implemented as a bottle opener aperture and which corresponds to the openings 10 and 12 with regard to its shape, size and mode of arrangement; analogously to opening 10, said opening 15 is, however, not provided with a bottle opener edge.

Each of the cutlery components 2, 3 and 4 is produced from an elongate, rectangular strip of material. The three strips of material all have the same length/and and the same width b and they are all identically rounded on the narrow sides thereof, the rounded area being preferably semicircular. When the cutlery is used as pocket cutlery, the length/(cf. FIG. 2) is less than 15 cm, preferably 10 to 12 cm, and the width b is 1.5 to 5 cm, preferably 2 to 4 cm.

The cutlery components are preferably made of an alloyed steel, in particular a rust-resistant steel sheet having a thickness s between 1 and 3 mm. The concave portions in the function areas 2*a* and 4*a* are deep drawn and the cutting edge provided in the function area 3*a* is ground. The openings 9, 10, 11, 12, 14, 15 as well as the tines 4*c* are formed by conventional processing steps, such as punching or the like.

With the exception of the slightly reduced width in the function area 4*a* of the fork 4, each cutlery component 2, 3, 4 has a constant width b in the function area 2*a* as well as in the handle area 2*b* so that, in spite of the short length/and in spite of the small, sheet metal-like thickness s of the material, it is guaranteed that the cutlery components can be gripped safely when they are handled; in particular the bottle opener apertures 10, 12 and 15 allow the user to pass his fingers through them so that his hand will not slip on the smooth surfaces.

The cutlery components 2, 3 and 4 can be interconnected. For this purpose, an arresting connection 16 is preferably provided, which comprises a carrier member 17 that is undetachably secured to one of the cutlery components, preferably the fork 4, as well as the openings 9 and 11 in the other cutlery components, preferably the spoon 2 and the knife 3. The carrier member 17 has a substantially cylindrical peripheral surface 17*a* and is secured in position in the opening 14 of the fork 4 in such a way that it projects beyond said opening 14 on both sides thereof. The peripheral surface 17*a* is dimensioned such that it also fits into the openings 9 and 11. An arresting lug 18*a* of at least one arresting element 18 projects radially outwards beyond the peripheral surface 17*a*. According to a preferred embodiment, three arresting elements 18 are arranged on both sides of the opening 14 such that they are uniformly distributed over the peripheral surface 17*a*. The arresting elements 18 are secured to the carrier member 17 in a resiliently yielding mode and in such a way that their arresting lugs 18*a* project beyond the peripheral surface 17*a* in the relaxed condition, but can be pressed into the peripheral surface 17*a* or to a position behind said peripheral surface 17*a*. If the carrier member 17 is made of plastic material, the arresting elements 18 can be formed on said carrier member 17 by respective cutting or milling operations or by means of shaping. The arresting lugs 18*a* are preferably bevelled or rounded in the radial direction so that conventional guide surfaces will be formed, through which the arresting element 18 will be urged radially inwards, if one of the openings 9 and 11, respectively, is pressed onto the carrier member 17 or pulled off said carrier member 17, the arresting element returning to its original position as soon as this pressure ceases to exist, i.e. as soon as the openings 9 and 11, respectively, have either been fully pushed over the carrier member or as soon as the cutlery components have been separated completely. The arresting lug 18*a* is arranged at a distance from the handle area 4*b* which is at least equal to the thickness s of the handle areas 2*b* and 3*b*, respectively.

The carrier member 17 is implemented as a ring and includes an inner through-hole 19.

One of the cutlery components 2, 3 or 4, preferably the fork 4 provided with the carrier member 17 of the arresting connection 16, additionally comprises an ear 20 on its rear end that faces away from the function area 4*a*, said ear 20 being provided with an opening 21. The ear 20 can be formed on the cutlery component 4 or it can be secured thereto in the usual way, and it projects rearwards subsequent to the length/and symmetrically with respect to the centre line a.

When the cutlery components 2, 3, 4 are not in use, they are preferably placed on top of one another such that they take up as little space as possible. A space-saving stacked arrangement of the cutlery components will inevitably be obtained, when the two cutlery components 2 and 4 are arranged such that their concave function areas 2*a*, 4*a* fit into each other and when the knife 3 is placed onto these two cutlery components on the negative side of the concave area such that it covers said concave area, the respective openings 9 and 11 being pushed over the arresting lugs 18*a* by applying a slight pressure thereto. Such a space-saving sequence is already predetermined by the structural design of the arresting connection 16 with the aid of which the individual cutlery components can be secured to one another. The arrangement of the carrier member 17 on one of the cutlery components 2, 4 having concave function areas 2*a*, 4*a* guarantees that this cutlery component will be arranged in the middle, whereby e.g. the tines 4*c* of the fork 4 will be covered. Due to the arresting lugs 18*a*, which project beyond the handle area of the middle cutlery component 4 to an extent corresponding essentially only to the thickness s of the material, it is guaranteed that the knife 3, which does not comprise a concave area, can only be secured to the negative side of the middle cutlery component 4, and that the second cutlery component, which is provided with a concave area, can only be arranged on the other side of the middle cutlery component 4 in such a way that the concave area of the cutlery component 4 will be accommodated in the concave area of the outer cutlery component 2. In the superimposed condition, the bottle opener apertures 10, 12 and 15 are in alignment with one another and define a free space that can be attached to a crown cork or the like.

Making reference to FIGS. 8 to 11, the protective housing 5 will be described in detail in the following. The protective housing 5 is made of a dimensionally stable material, in particular a plastic material. The protective housing 5 is elongate and rectangular in shape and is implemented similar to an etui or a case; it is so closely adapted to the shape and the dimensions of the cutlery components 2, 3 and 4 that the cutlery components are held closely together. The protective housing 5 is implemented as a slip case and comprises a top wall 22, a bottom wall 23 and a side wall 24, which encompass an interior space 25. The interior space 25 has a width B which is identical to or insignificantly larger than the width b of each of the cutlery components 2, 3 and 4 and it has a length L which is at least identical to, but preferably also slightly greater than the length l. In particular the width B should, however, not exceed the width b by more than 1 to 2 mm so as to guarantee that the cutlery components 2, 3, 4 are secured in position when they are accommodated in said interior space, and that the transportable unit holds together. Also the length L may exceed the length/by 1 mm or more.

The interior space 25 is accessible via an insertion opening 26. The insertion opening 26 is provided in the side wall 24 on one of the narrow sides and is preferably formed in that the side wall 24 ends before the rounded portion of the narrow side so that the insertion opening 26 extends over the whole width B.

The bottom wall 23 is flat over its entire length up to the insertion opening 26. The top wall 22 is flat over the area corresponding to the handle areas 2*b*, 3*b*, 4*b* and comprises a curved region 22*a* whose shape and size is adapted to the concave areas of the function areas 2*a*, 4*a*, said curved region 22*a* opening, however, towards the insertion opening 26 in a mouthlike fashion.

The width of the side wall 24 is dimensioned such that the interior space 25 has a height S which corresponds to three times the thickness s of the cutlery components as well as to twice the axial dimensions 18, or which is slightly larger than that—preferably 1 mm or less—so as to avoid major friction.

The bottom wall 23 of the protective housing 5 is provided with an opening 27 whose mode of arrangement and size corresponds to the mode of arrangement and the size of the bottle opener apertures 10, 12 and 15 of the cutlery components 2, 3 and 4, said opening 27 being, however, preferably larger than these bottle opener apertures, in particular in a direction along the longitudinal centre line a. On the rear end of the protective housing 5, which faces away from the insertion opening 26, an opening 28 is provided, which extends through the top wall 22 as well as through the bottom wall 23. The opening 28 is preferably oriented such that it extends coaxially with the opening 19 of the carrier member 17, but its size exceeds that of said opening 19, preferably in the direction of the longitudinal centre line a.

The opening 28 is implemented as part of a connection means 29 with the aid of which the cutlery components 2, 3, 4 are releasably secured in position in the protective housing 5. The connection means 29 is implemented such that it will automatically lock the cutlery components 2, 3, 4, when these components are inserted in the protective housing 5, the locking being automatically released, when the cutlery components are removed from the protective housing 5. In the embodiment shown, this function is fulfilled by an arresting element 30, which projects radially inwards beyond the circumference of the opening 28; preferably, two arresting elements 30 are provided, one of said elements being arranged on the bottom wall 23 and the other one on the top wall 22. In the embodiment shown, the arresting elements 30 are arranged on both walls 22, 23 at the same location, i.e. on the rear end of the protective housing 5 and symmetrically with respect to the longitudinal centre line a; the arresting elements may, however, also occupy different positions.

Figure 14:
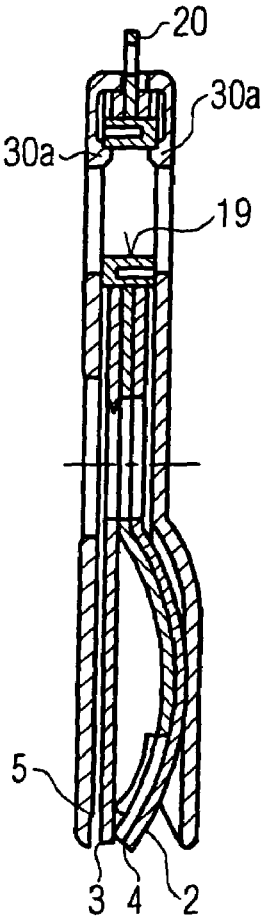
FIG. 14 shows a longitudinal section through the cutlery according to FIG. 13.

Each arresting element 30 comprises an arresting lug 30*a*, which, as can especially be seen from FIG. 14, projects into the opening 28 and which has bevelled end faces. The arresting lugs 30*a* are dimensioned and arranged such that they are adapted to engage the opening 19 of the annular carrier member 17.

The side wall 24 has provided therein a slot-shaped opening 31, which is arranged on the rear side that faces away from the insertion opening 26 and which is configured for receiving therein the ear 20. Also the opening 31 constitutes part of the connection means 29 for releasably connecting the cutlery components 2, 3, 4 in the interior of the protective housing 5.

When the cutlery components 2, 3, 4 have been assembled in the manner described, they are inserted, with the handle areas 2*b*, 3*b*, 4*b* first, through the insertion opening 26 into the interior space 25 until they strike against the projecting arresting lugs 30*a* of the connection means 29. These arresting lugs 30*a* slide onto the cutlery components with their bevelled surfaces, and the arresting elements 30 are urged outwards. As soon as the opening 19 is, however, located below the arresting lugs 30*a*, said arresting lugs 30*a* will spring back to their original position and hold the cutlery components 2, 3, 4 in the interior of the protective housing 5, as shown in FIG. 14.

At the same time, also the ear 20 has, however, passed through the connection opening 31 so that its opening 21 is exposed for the purpose of locking, e.g. by the fastening means 7 of the carrying means 6.

Due to the fact that the opening 27 in the protective housing 5 is in alignment with the bottle opener apertures 11, 12 and 15, the bottle opener is capable of operating even if the cutlery components are positioned in the protective housing 5. However, the enlarged opening 27 also serves to provide an enlarged free space for applying the bottle opener edge 13 to a crown cork or the like. Furthermore, the opening 27, which is exclusively provided in the bottom wall 23 of the protective housing 5, serves to guarantee that the user will use the bottle opener always in a position in which the bottle opener edge 13 is located below the two other cutlery components and can thus easily engage the crown cork from below. It should be remembered that the bottle opener edge 13 is provided on the knife 3 and that, due to the structural design of the arresting connection 16 and due to the curved region 22*a*, the knife 3 can only be located at the lowermost position of the superimposed cutlery components, said lowermost position being, in the protective housing 5, the position adjacent the bottom wall 23 which has the bottle opener aperture 27 provided therein. There is, however, no reason why a corresponding bottle opener aperture should not be provided in the top wall 22 as well.

Figure 12:
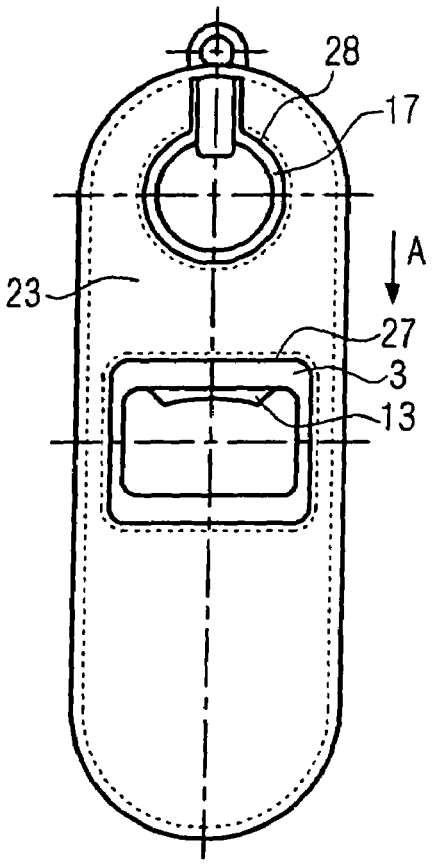
FIG. 12 shows a representation of the protective housing similar to that shown in FIG. 8, with cutlery components accommodated in said protective housing.
Figure 13:
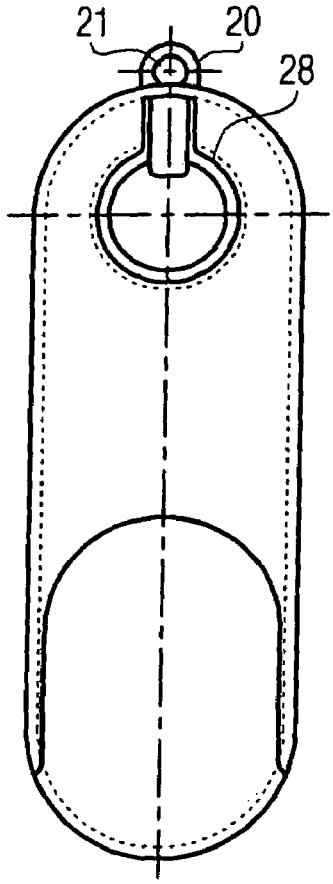
FIG. 13 shows a representation of the protective housing similar to that shown in FIG. 10, with cutlery components accommodated in said protective housing.

As can be seen in FIGS. 12 and 13, the enlarged openings 28 in the protective housing 5 have the effect that a part of the carrier member 17 is exposed towards the top and towards the bottom and defines a releasing unit for releasing the arresting elements 30, when the cutlery components are removed from the protective housing. When a finger or some other object is passed through the opening 28 and inserted into the opening 19, the cutlery components 2, 3, 4 can be displaced by the application of pressure in the direction of the arrow A towards the insertion opening 26; this has the effect that the arresting lugs 30*a* will again slide onto the cutlery components so that the arresting elements 30 will be urged outwards and the connection means will be released (of course after unlocking of the ear 20).

The same effect is produced, when a user passes his finger or some other object through the aligned bottle opener apertures 27, 10, 12 and 15 and applies pressure in the direction of the arrow A.

For separating the cutlery components 2, 3, 4, the arresting lugs 18*a* must be pressed into the peripheral surface 17*a* of the carrier member 17; the simplest way of doing this is a relative rotation of neighbouring cutlery components about the peripheral surface 17*a*, which is implemented as a rotary bearing, and a tilting movement.

As a modification of the embodiment described and shown hereinbefore, the connection means used for connecting the cutlery components to the protective housing may comprise either only the arresting element or only the ear. Instead of the arresting element, clips or the like may be used. Also the removal of the cutlery components from the protective housing can be performed e.g. by a pressure pin or the like. When the cutlery components are connected to one another, this can also be realized by arresting elements having a different structural design or by clamp connections or snap-on connections. The bottle opener need not necessarily be implemented in the way described, but it may e.g. be omitted or implemented as a separate, independent cutlery component. The embodiment according to the present invention can be used not only for pocket cutlery but also for cutlery components having a normal size. In addition, the cutlery may be produced not only from metal but also from plastic material or even from wood.

The invention claimed is:

1. Cutlery comprising a plurality of superimposable cutlery components adapted to be releasably connected so as to form a transportable unit, the individual cutlery components (2, 3, 4) being interconnected via an arresting connection (16), the arresting connection (16) including at least one opening (9, 11) in a first cutlery component (2, 3), which is engaged by at least one resiliently movable first arresting element (18) arranged on a second cutlery component (4), wherein the arresting connection (16) includes a carrier member (17), which is secured in position in an opening (14) provided in the second cutlery component (4), the carrier member including a peripheral surface (17*a*) provided with the first arresting element (18) that projects beyond the peripheral surface, wherein the first cutlery component (2, 3) can be pressed onto the second cutlery component (4) such that the carrier member (17) is received in the opening (9, 11), wherein the carrier member (17) is implemented as a ring and the interior of the ring is implemented as an opening (19) for receiving a sound arresting element (30) which is arranged on a protective housing (5) so as to releasably connect the cutlery components (2, 3, 4) to the protective housing (5), the protective housing (5) accommodating the cutlery components (2, 3, 4).

2. Cutlery according to claim 1, wherein the carrier member (17) projects on both sides of the second cutlery component (4) and is provided with a plurality of first arresting elements (18).

3. Cutlery according to claim 1, wherein the arresting connection (16) comprises a rotary bearing for allowing a rotation of the cutlery components (2, 3, 4) relative to one another.

4. Cutlery according to claim 1, wherein the carrier member (17) is provided with a cylindrical peripheral surface (17*a*) which acts as a rotary bearing.

5. Cutlery according to claim 1, wherein the second cutlery component (4) including the carrier member (17) is provided with an ear (20), which is adapted to be passed through a connection opening (31) formed in the protective housing (5) that accommodates the cutlery components (2, 3, 4), the ear (20) being locked so that the cutlery components (2, 3, 4) are releasably secured in position in the protective housing (5).

6. Cutlery according claim 1, wherein the cutlery components are implemented as pocket cutlery having a length of less than 15 cm.

7. Cutlery according to claim 1, wherein the cutlery components (2, 3, 4) include a bottle opener, the bottle opener being accessible through an opening (27) in the protective housing (5) so that it can fulfill its function.

8. Cutlery accordingly claim 7, wherein each cutlery component (2, 3, 4) includes a bottle opener aperture (10, 12, 15), the respective bottle opener apertures being in alignment in the superimposed condition of the cutlery components (2, 3, 4).

9. Cutlery according to claim 8, wherein the bottle opener aperture (12) formed in one of the cutlery components (3) is provided with a bottle opener edge (13).

10. Cutlery according to claim 1, wherein each of the plurality of superimposable cutlery components include a function area (2*a*, 3*a*, 4*a*) and a handle area (2*b*, 3*b*, 4*b*), and are produced from an elongate, substantially rectangular strip of material, the respective function area (2*a*, 3*a*, 4*a*) being formed on one end of each strip of material.

11. Cutlery according to claim 10, wherein the cutlery components (2, 3, 4) are substantially identical in width (b) between the front and the rear end.

12. Cutlery according to claim 10, wherein the handle area (2*b*, 3*b*, 4*b*) has the shape of a flat strip.

* * * * *

UNITED STATES PATENT AND TRADEMARK OFFICE

CERTIFICATE OF CORRECTION

PATENT NO. : 7,100,288 B2
APPLICATION NO. : 11/122886
DATED : September 5, 2006
INVENTOR(S) : Claudia Kohler et al.

It is certified that error appears in the above-identified patent and that said Letters Patent is hereby corrected as shown below:

On the Title Page:

Item (30), "202005002065" should be -- 202005002065.6 --.

At Column 9, line 30, "sound" should be -- second --.

Signed and Sealed this

Thirty-first Day of July, 2007

JON W. DUDAS
*Director of the United States Patent and Trademark Office*